US007032902B1

(12) United States Patent
Yuan

(10) Patent No.: US 7,032,902 B1
(45) Date of Patent: Apr. 25, 2006

(54) CASINO CARD GAME

(76) Inventor: Tsuan Yuan, 4628 Nolan Lane, Las Vegas, NV (US) 89107

( * ) Notice: Subject to any disclaimer, the term of this patent is extended or adjusted under 35 U.S.C. 154(b) by 132 days.

(21) Appl. No.: 10/376,223

(22) Filed: Feb. 27, 2003

(51) Int. Cl.
*A63F 1/00* (2006.01)

(52) U.S. Cl. ..... 273/274; 273/292

(58) Field of Classification Search ..... 273/274, 273/292, 309
See application file for complete search history.

(56) References Cited

U.S. PATENT DOCUMENTS 6,070,876 A * 6/2000 Ko ..... 273/293
6,371,484 B1 4/2002 Yuan

* cited by examiner

*Primary Examiner*—William M. Pierce
(74) *Attorney, Agent, or Firm*—Robert Ryan Morishita Ryan Morishita; Anderson & Morishita, LLC

(57) ABSTRACT

Players place a base wager on either a first hand or a second hand. Proposition wagers for pushes, ties, and bonus holdings may be placed. Three cards are dealt to a first and a second hand. Either hand may automatically win if it includes a predetermined three-card combination. If neither hand automatically wins, the hands are divided into two-card and single-card component hands. The component hands are compared. A tie occurs if the cards of each hand are equal in rank. A push occurs if each hand has one component hand that outranks the corresponding component hand of the other hand. Otherwise, a hand wins when both component hands outrank or tie the corresponding component hands of the other hand. Players wagering on the winning hand are rewarded.

15 Claims, 6 Drawing Sheets

CASINO CARD GAME

FIELD OF THE INVENTION

The present invention relates to casino card games. Specifically, the present invention is a card game in which a player wagers on one of two hands and is rewarded if, upon comparison, the player has wagered on the higher ranking hand.

BACKGROUND OF THE INVENTION

Card games such as Pai Gow Poker and Baccarat are well known forms of casino-type games. Specifically, these games are attractive to players because these games give the player a reasonable chance of winning their wager. Moreover, these games provide the casinos with a reasonable return for hosting the game.

Baccarat is a live table game that uses a standard deck of fifty-two playing cards. The object of the game of Baccarat is for the bettor to successfully wager on whether the Bank's hand or the Player's hand is going to win. The bettor receives even money for his wager if he selects the winning hand and loses his wager if he selects the losing hand. Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined, modulo ten. The highest hand value in Baccarat is nine. All hand values range from a low of zero to a high of nine. If when the cards are added together, the total of the hand exceeds nine, then the hand value is determined modulo ten. For example, a seven and a eight total fifteen, but the hand value is five. An Ace and a nine total ten, but the hand value is zero. Whichever of the Bank hand or the Player hand is closest to a total of nine is the winner.

Depending on the point total of the initial Player's hand and the initial Dealer's hand, one more card may be dealt to either the Player's hand, the Dealer's hand or both. The rules for determining whether a third card is dealt are fixed; that is, there is no discretion for either the Player's hand or the Dealer's hand on whether a third card is dealt.

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule # 1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Bank hand two card point total: | Bank hand DRAWS when the Player's hand third card is: | Bank hand STANDS when the Player's hand third card is: |
|---|---|---|
| 0, 1, or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Bank always stands |

At the end of each hand, winning wagers are paid and losing wagers-are collected by the house. Any commission due to the house is marked in commission boxes in the center of the table.

One drawback of Baccarat is that the draw rules are complicated. Moreover, Baccarat is an unfamiliar game to most bettors. Thus, some players are intimidated from playing.

In Pai Gow Poker, seven cards are dealt to the banker and the players. The banker and players arrange the cards into a five-card high hand and a two-card low hand. Each player compares his or her high hand to the banker's high hand and his or her low hand to the banker's low hand. The player wins if both hands outrank the corresponding banker's hands according to conventional poker rankings. If one of the player's hands outranks one of the banker's hands, and the other banker's hand ties or outranks the other player hand, the player and banker "push" and the player neither wins nor loses his wager. If both the banker's hands outrank or tie the player's hands, the player loses his or her wager.

It can be seen that Pai Gow Poker lacks complicated draw rules; the player uses the cards he or she is dealt. Also, the comparison of hands in Pai Gow Poker is still fairly complicated and can be difficult to apply unless the player is familiar with conventional Poker rankings.

In my prior game, disclosed in U.S. Pat. No. 6,371,484, there were no complicated draw rules and simplified rules for forming component hands. However, there were no wagers available for players to receive large payouts.

SUMMARY OF THE INVENTION

A casino card game between a casino and at least one player using at least one deck of fifty-two cards begins with the player placing a base wager on either a firsthand or a second hand. The game may also include one or more of the following optional wagers: a push wager, a tie wager, or a bonus wager.

A dealer deals three cards to a first hand and three cards to a second hand. The first hand and second hand are examined. In an optional embodiment including a bonus wager, any player placing a bonus wager is rewarded if the combination of at least one of the cards of the first hand and at least one of the cards of the second hand form a bonus holding.

If either hand has a predetermined three-card combination, optionally a three of a kind, the first hand is compared to the second hand. The winning hand is the hand with the higher ranking three-card combination.

If neither hand has the predetermined three-card combination, the first and second hands are each arranged into a two-card component hand and a single-card component hand. The component hands of the first hand are compared to the corresponding component hands of the second hand.

If the three cards of the first hand are equal in rank to the three cards of the second hand, a tie is declared. In an optional embodiment in which a tie wager is offered, any player placing a tie wager is rewarded when a tie is declared. A tie outcome may also optionally result in the return of each player's base wager.

If one component hand of the first hand outranks the corresponding component hand of the second hand and the remaining component hand of the second hand outranks the corresponding component hand of the first hand, a push is declared. In an optional embodiment in which a push wager is offered, any player placing a push wager is rewarded when a push is declared. A push may result in the return of a player's base wager.

Otherwise, the winning hand is the hand with one component hand outranking the corresponding component hand of the other hand and the remaining component hand outranking or tying the corresponding component hand of the other hand. Players placing a base wager on the winning hand are rewarded. Optionally, the casino retains a commission on all winning base wagers.

In a second aspect of the present game, each player wagers on his or her own hand rather than community hands. More specifically, each player places a base wager on the player's own hand. Additional wagers may be offered including one or more of a tie wager, a push wager, or a bonus wager.

Three cards are dealt to each player and to the dealer. In an optional embodiment including a bonus wager, any player placing a bonus wager is rewarded if the combination of at least one card of the player's hand and at least one card of the dealer's hand form a bonus holding.

The three cards of the player hand are examined. If the player hand includes a predetermined three-card combination, optionally a three of a kind, the player hand may automatically win or, alternatively, may be compared to the dealer hand. In an optional embodiment in which a comparison is made, if only the player hand has a predetermined three-card combination, the player hand is the winning hand. If both the player hand and the dealer hand hold a predetermined three-card combination, the hand with the higher ranking three-card combination is the winning hand.

If the player hand does not include a predetermined three-card combination, both the player hand and the dealer hand are arranged into a two-card component hand and a one-card component hand. The component hands of the player hand are compared to the corresponding component hands of the dealer hand.

A tie is declared if each of the three cards of the player hand are equal in rank to the three cards of the dealer hand. In an optional embodiment including a tie wager, any player placing a tie wager is rewarded when a tie is declared. Optionally, the player's base wager is also returned in the event of a tie.

A push is declared if one of the player component hands outranks the corresponding dealer component hand but the remaining player component hand is outranked by the corresponding dealer component hand. In an optional embodiment including a push wager, any player placing a push wager is rewarded when a push is declared. Optionally, the player's base wager is also returned in the event of a push.

Otherwise, the player hand is designated the winning hand, and the player is rewarded on the player's base wager, if both the player component hands outrank the corresponding dealer component hands. Conversely, the dealer hand is designated the winning hand if both the dealer component hands outrank the corresponding player component hands. Optionally, copy component hands may be handled in a variety of ways including making copy component hands a dealer win, a player win, or a push, as the house desires.

DESCRIPTION

Figure 1:
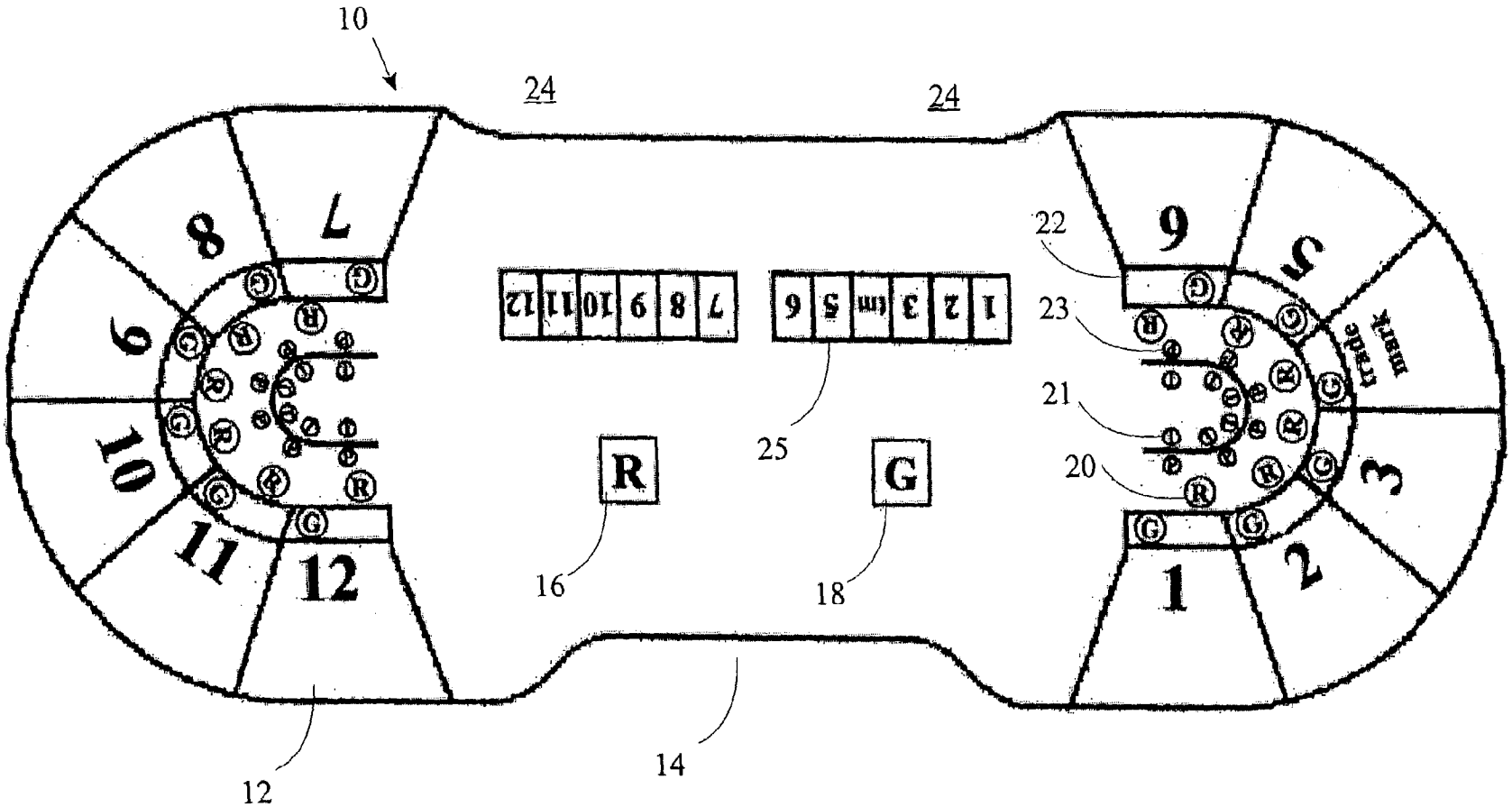
FIG. 1 is a top view of the table layout used for a game method according to an embodiment of the present invention.
Figure 2:
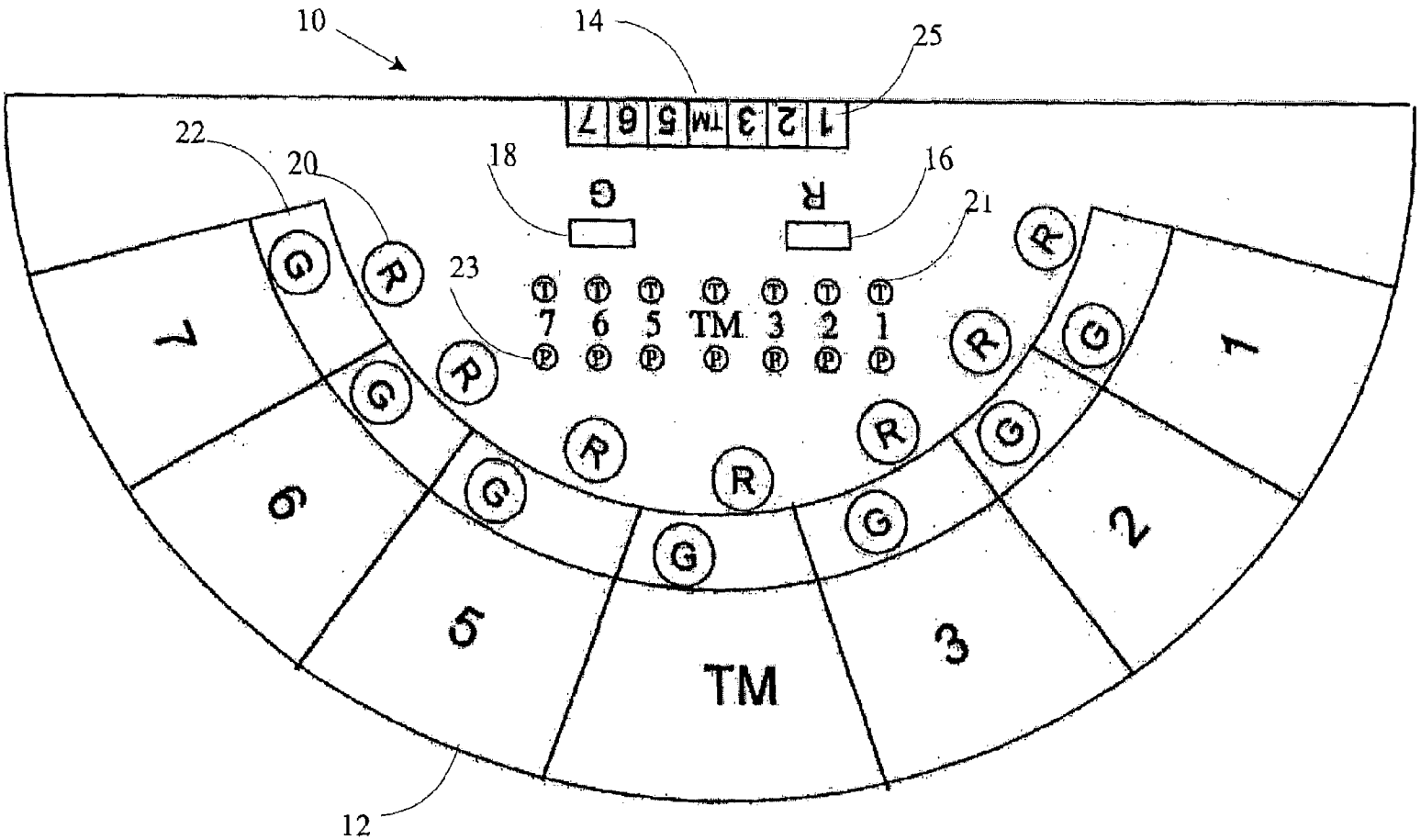
FIG. 2 is a top view of the table layout used for a game method according to an alternate embodiment of the present invention.

Reference is now made to the figures wherein like parts are referred to by like numerals throughout. With reference to FIGS. 1 and 2, the game of the present invention is played on a table layout 10 including player areas 12 and dealer areas 14. The layout 10 additionally includes areas for a first hand 16, referred to in the example below as the red hand 16, and a second hand 18, referred to in the example below as the green hand 18. The player areas 12 include a plurality of red hand betting areas 20 and a plurality of green hand betting areas 22. The player areas 12 may also include optional tie wager areas 21, push wager areas 23, and/or bonus wager areas (not shown). The layout 10 of FIG. 1 is has three areas for employees, a dealer area 14 for a dealer who deals cards and two croupier areas 24 for croupiers who pay and collect wagers. In the optional embodiment of FIG. 2, the layout 10 has a single dealer area for a dealer who performs all tasks.

Figure 3:
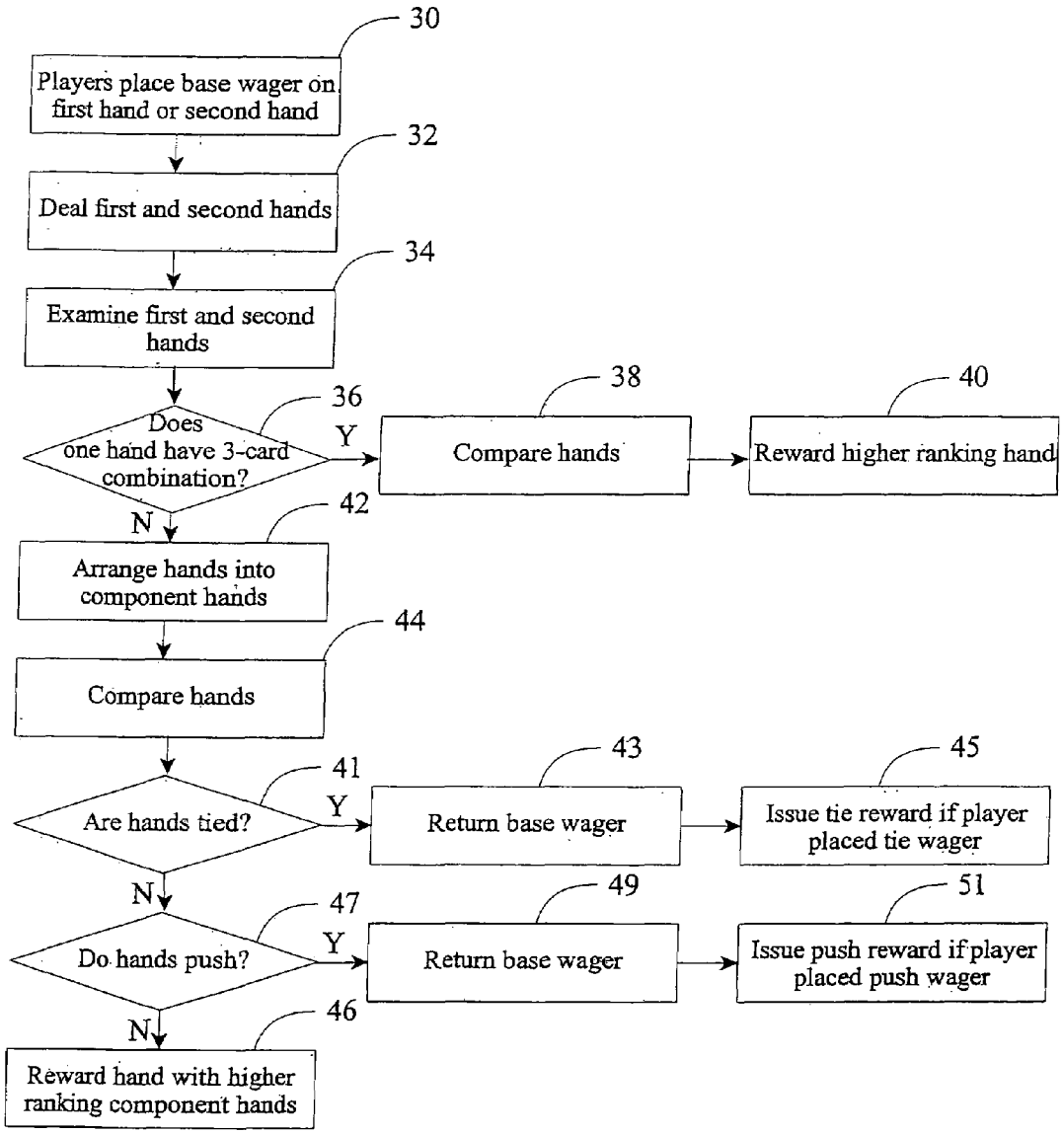
FIG. 3 is a flow chart of a game method according to an embodiment of the present invention.
Figure 4:
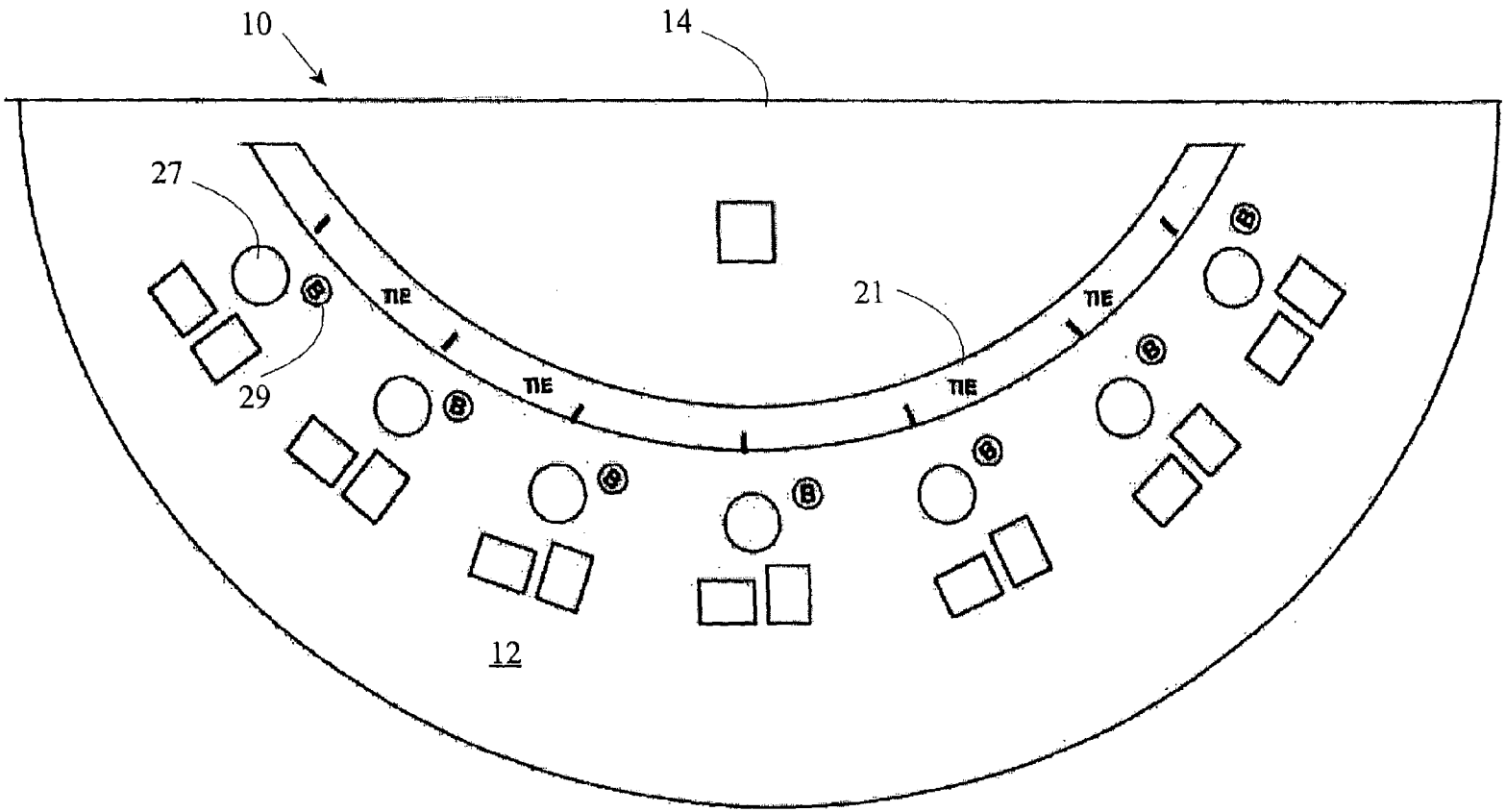
FIG. 4 is a top view of the table layout used for a game method according to an alternate embodiment of the present invention.

With reference to FIGS. 3 and 4, the game of the present invention is played between at least one dealer and at least one player. The game of the present invention is played with a conventional deck of fifty-two playing cards. Optionally, a plurality of decks, such as seven, may be used in conjunction with a card shoe. After the cards are randomized, such as through shuffling and cutting, the players place their base wagers 30. In a first aspect of the present game, shown in FIG. 3, each player places a base wager on one of the two community hands, either the first hand, also referred to as a red hand, or the second hand, also referred to as a green hand. In a second aspect of the present game, shown in FIG. 4 and described hereinafter, each player is dealt 50 and places a base wager on 48 his or her own hand.

In either aspect, a player may also place optional proposition wagers, such as a tie wager, push wager, or bonus wager. These proposition wagers may be offered as side wagers to the base wager or alternate wagers. That is, it is contemplated that a player may be required to place a base wager to place a tie wager, push wager, or bonus wager. Conversely, it is also contemplated that a player may be free to place any wager offered without regard to whether the player placed a base wager. It is also contemplated that fewer than all of the optional wagers may be offered. That is, any particular game may include only the tie wager, only the push wager, only the bonus wager, only two of the tie wager, push wager, or bonus wager, or all three of the tie wager, push wager, and bonus wager. It is also noted that the wagers are not necessarily mutually exclusive and the player place one or more of the wagers offered. Resolution of the tie wager and push wager will be described in greater detail below. However, resolution of the bonus wager requires some explanation prior to describing game play.

In an optional embodiment including a bonus wager, a set of bonus holdings are defined prior to dealing the playing cards. The bonus holdings could take any form but optionally include at least one card from the first hand in combination with at least one card from the second hand. As an example, Table 1 lists possible bonus holdings and possible associated payouts.

TABLE 1

| Bonus Holding | Payout |
|---|---|
| Two hands with K A A and A 2 2 | 2800:1 |
| Six card straight flush | 2000:1 |
| Six of a kind | 1000:1 |
| Five of a kind | 100:1 |
| Five card royal flush | 60:1 |
| Five card straight flush | 35:1 |
| Four of a kind + pair | 30:1 |
| Three of a kind + three of a kind | 20:1 |
| Full house | 4:1 |
| Six card flush | 3:1 |
| Five card flush | 2:1 |
| Five card straight | 2:1 |

Referring to FIG. 3, in one embodiment of the first aspect of the present invention, the dealer deals 32 a three card red hand and a three card green hand and places them face up on the layout 10 at the red hand area and the green hand area. In an alternate embodiment, the dealer may deal three cards face down to the red hand area and three cards face down at the green hand area. The dealer may then build suspense by passing two cards from the green hand to the highest green hand bettor to expose before the dealer exposes the final card of the green hand. Alternatively or additionally, the dealer may do likewise with the red hand.

Once the green hand and red hand are exposed, the dealer examines 34 the first hand and the second hand. In an optional embodiment including a bonus wager, the dealer would determine whether the first hand and second hand combine to form a bonus holding, as described above. If at least one card of the first hand in combination with at least one card of the second hand form a bonus holding, any player who placed a bonus wager is rewarded.

After resolving bonus wagers, if any, the dealer determines 36 whether either hand has a predetermined three-card combination, such as a three of a kind. If only one hand has the three-card combination, that hand is the winning hand 40. For example, if the red hand is 4♢4♡4♤and the green hand is 3♡10♡K♧the red hand is the winning hand. In the example, all players wagering on the red hand are rewarded 40 and all wagers placed on the green hand are collected. Optionally, the house may collect a commission, such as 5%, for all winning wagers. If both hands have the three-card combination, the hands are compared 38. The hand with the higher ranking combination is the winner 40. For example, if the red hand is 5♧5♡5♤and the green hand is 8♧8♢8♡, the green hand is the winner. In this example, all players wagering on the green hand are rewarded 40 and all wagers placed on the green hand are collected. In setting the rankings, the house may optionally implement a rule that aces are the lowest ranked card or that aces are lower than deuces but higher than any other card (i.e. A♡A♢A♤Beats 7♢7♤7♡but loses to 2♢2♤2♡).

If a multi-deck shoe is used, it is possible that both hands have equal ranking three-card combinations. If this occurs, in one optional embodiment, a tie is declared and base wagers are neither collected nor rewarded 40, although optional tie wagers may be paid as discussed below.

If neither hand has the predetermined three-card combination, the dealer arranges 42 each hand into two component hands, a two-card high hand and a single-card low hand. The house may optionally institute a rule in which the high hand must outrank the low hand. Similarly, the house may optionally adopt house rules for how the dealer must arrange 42 the dealer's component hands. Specifically:

(1) Split pairs of aces, i.e. play one ace in each component hand, unless the third card is a King;

(2) Split pairs of Kings, i.e. play one King in each component hand, unless the third card is a Jack, Queen, or ace;

(3) Play all other pairs as the two-card component hand;

(4) If the hand has no pairs, play the second highest card as the single-card hand and the remaining cards as the two-card hand.

The red high hand is compared 44 to the green high hand and the red low hand is compared to the green low hand. While any ranking system could be used, for simplicity, the house may institute house rules that only two hands rank: a pair and high card. In other words, the house may eliminate such hands as straight flush, flush, straight, and the like for the sake of simplicity and make a pair the highest ranking hand and high card the next highest hand (like poker, if the highest ranking cards match, one looks to the next highest card, i.e. Q♡8♡outranks Q♧3♧). In such an embodiment, for example, the red high hand of 5♢5♧beats a green high hand of Q♤K♤. Likewise, a red high hand of 4♡8♢beats a green high hand of 3♧6♧. As with above, the house may optionally implement a rule that aces are the lowest ranked card or that aces are lower than deuces but higher than any other card (i.e. A♡A♢A♤beats J♢J♤J♡but loses to 2♢2♤2♡).

A hand is declared the winner 46 if the high hand and the low hand outrank the high hand and low hand of the other hand. For example, a green hand of 7♡7♤and K♢wins over a red hand of J♧8♢and 9♡. Likewise, a hand is declared the winner if one of the component hands, either the high hand or the low hand, outrank the other hand's corresponding component hand and the remaining component hand matches the other hand's corresponding component hand. Thus, a red hand of K♡5♧and 7♤wins over a green hand of J♧2♢and 7♡or a green hand of K♢5♢and 6♡.

A tie is declared 41 if the three cards of the first hand are equal in rank to the three cards of the second hand. For example, 4♧4♡and 7♢ties with 4♢4♤and 7♡because the values are equal in rank even though the suits of the cards do not match. In the event of a tie, the player's base wager may be returned 43, although this could be changed by house rule. Additionally, in an optional embodiment including a tie wager, any player placing a tie wager may be rewarded 45 in the event of a tie. In such an optional embodiment, the tie payout may depend on the extent to which the suits of the two hands match. An example of an optional paytable is given in Table 2:

TABLE 2

| Tie Holding | Payout |
|---|---|
| Hands hold cards of equal value in different suits | 25:1 |
| Hands hold cards of equal value in same suits | 50:1 |

A push is declared 47 if one red component hand outranks the corresponding green component hand while the remaining green component hand outranks the remaining red component hand. For example, 5♡5♠and 9♣pushes with K♠4♢and 10♡because a pair of fives outranks King high but a ten outranks a nine. Similarly, K♠4♢and 10♡pushes K♣3♢and J♠since King and four outrank King and three but Jack outranks a ten. In the event of a push, the player's base wager may be returned 49, although this could be changed by house rule. Additionally, in an optional embodiment including a push wager, any player placing a push wager may be rewarded 51 in the event of a push. In such an optional embodiment, the push payout may be greater than even money such as 2:1, although this may be changed by house rule.

Base wagers are resolved by rewarding 46 players placing base wagers on the winning hand and collecting base wagers from players placing base wagers on the losing hand. Optionally, the base wagers are rewarded at even money. Side wagers, that is, push wagers, tie wagers, and bonus wagers, placed on an outcome that did not occur are collected. In an optional embodiment, a commission is charged by the house for winning wagers. With reference to FIGS. 1 and 2, the commission owed by each player may be tracked at a commission area.

Figure 5:
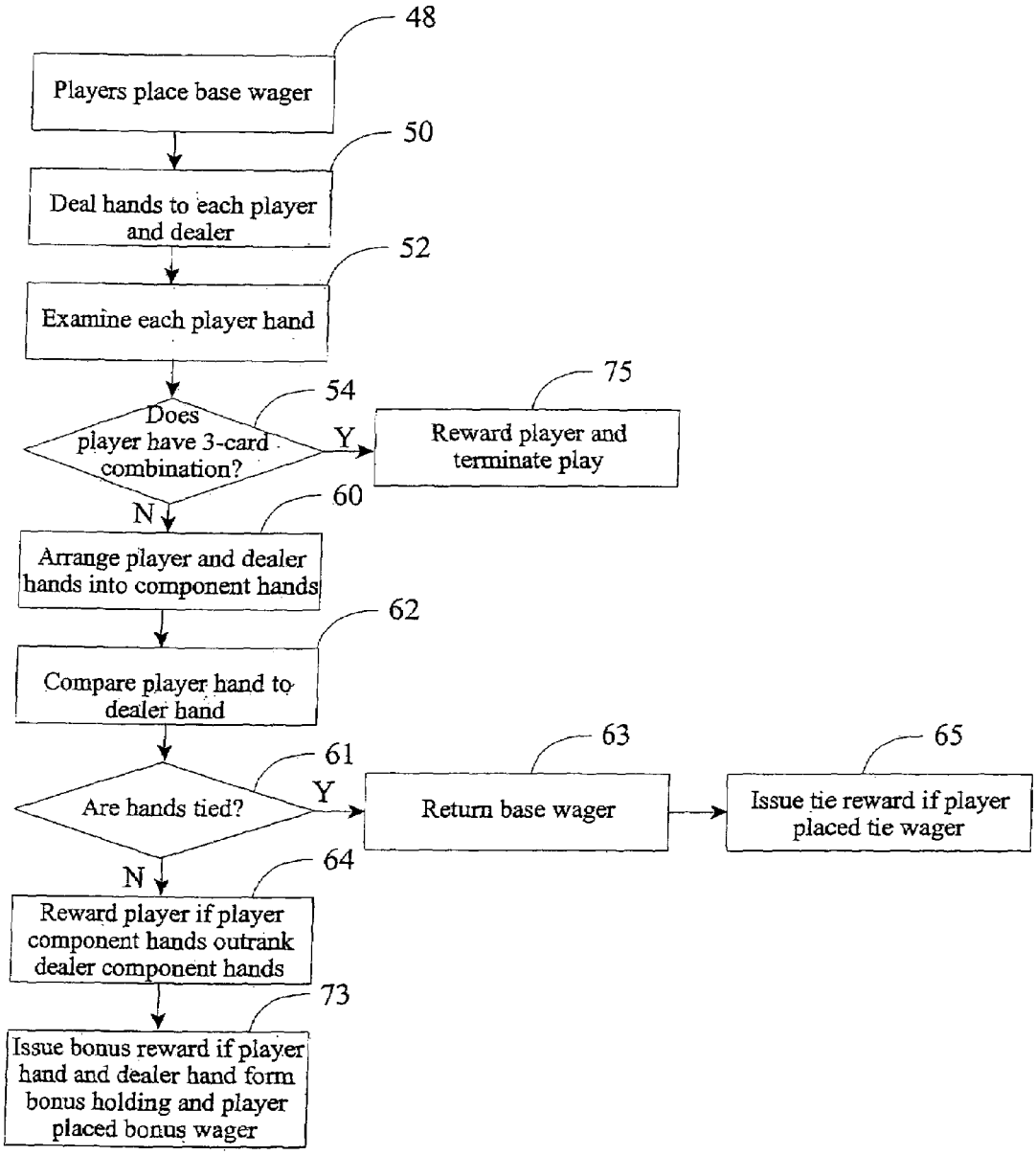
FIG. 5 is a flow chart of a game method according to an alternate embodiment of the present invention.

Referring to FIGS. 4 and 5, in a second aspect of the present invention each player places a base wager 48 at a player wagering area 27 on the table layout 10. Again, one or more of a push wager, tie wager, or bonus wager may also be offered. Players place a push wager by wagering at a push wager area (not shown), a tie wager by wagering at a tie wager area 21, or a bonus wager by wagering at a bonus wager area 29. As with the first aspect, these wagers are not necessarily mutually exclusive and a player may be permitted to place none, one, two, or all three side wagers.

The dealer deals three cards 50 to each wagering player and to the dealer at the player areas 12 and dealer area 14, respectively. In this aspect of the present invention, rather than wagering on community hands, each player wagers on whether the player's own hand will outrank the dealer's hand.

Each player hand is serially examined 52 to determine 54 whether the player hand has a predetermined three-card combination, such as a three of a kind. Any hand having the three-card combination is the winner 58. The situation where a dealer also has a three-card combination could be handled in many ways. In one optional embodiment, shown in FIG. 5, the player automatically wins regardless of the dealer's hand. Base wagers are paid 75 for players with automatic winning hands, optionally at greater than even money, and play is terminated with respect to those players.

Figure 6:
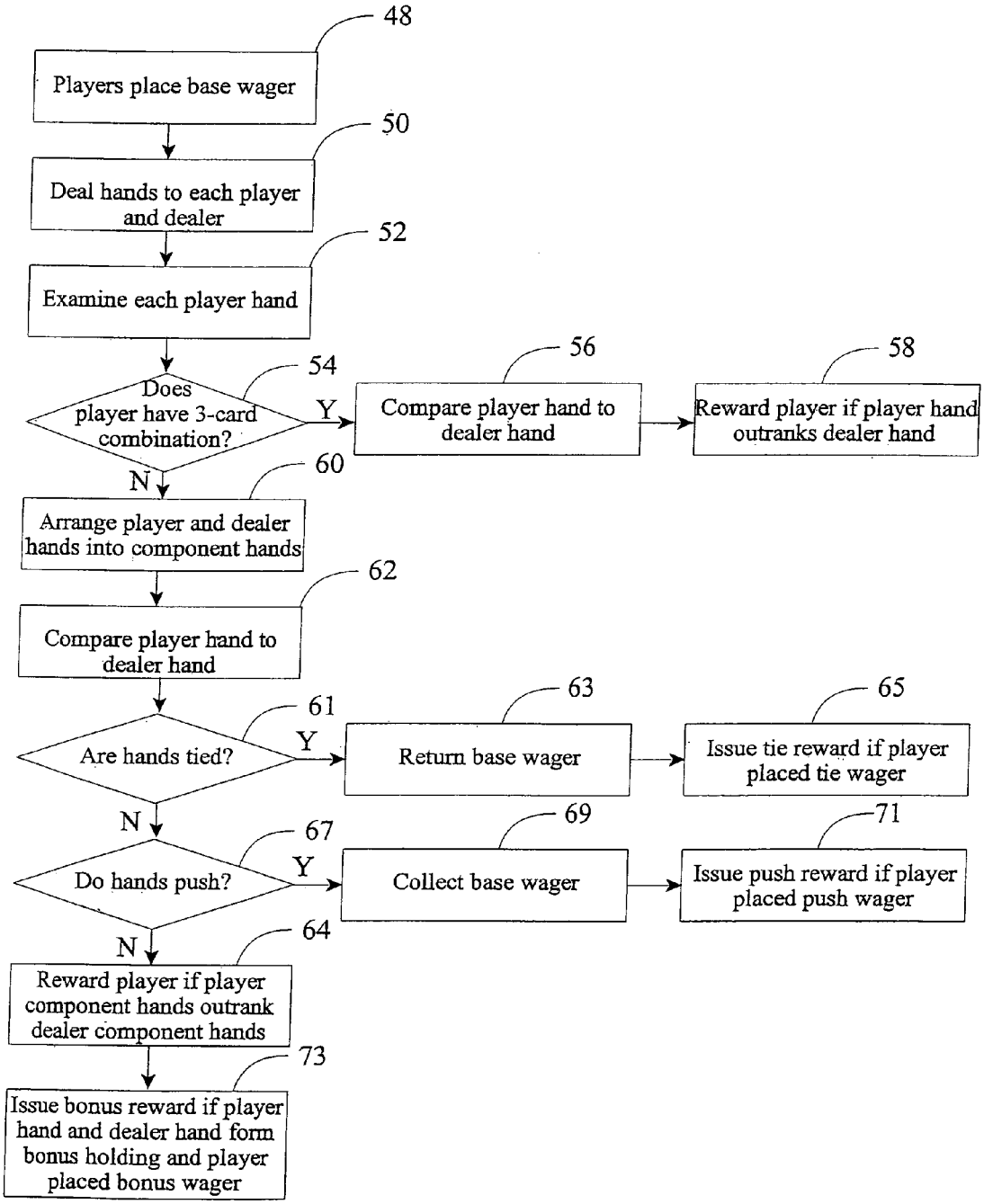
FIG. 6 is a flow chart of a game method according to an alternate embodiment of the present invention.

In an alternate embodiment, shown in FIG. 6, the player wins unless, comparing 56 the player hand to the dealer hand, the dealer has a three-card combination outranking the player hand. For example, if the player hand is 4♢4♡4♣and the dealer hand is 3♡10♡K♣the player hand is the winner. Conversely, if the player hand is 4♡4♠and the dealer hand is 7♣7♢7♡the dealer hand wins. Also, in an optional embodiment, the house may implement a rule that player's hands with three of a kind aces or Kings automatically win. Thus, a player hand K♢K♡K♠wins even if the dealer has A♢A♡A♠. Likewise, the house may implement a house rule that aces are lower than deuces but higher than any other card (i.e. A♡A♢A♠beats 7♢7♠7♡but loses to 2♢2♠2♡). That is, three of a kind deuces may be the highest ranking three of a kind. Base wagers are paid 58 if the player has a winning hand or collected if the dealer has a winning hand.

If a multi-deck shoe is used, it is possible that both hands have equal ranking three-card combinations. In an optional embodiment of the second aspect of the game, when this occurs, the player loses his base wager. That is, a copy hand is optionally considered a losing hand for the player and a winning hand for the dealer. However, in an optional embodiment including a tie wager, a game in which both the dealer and player have the same three of a kind may result in the player being paid on his tie wager without regard to whether he lost or won his base wager. That is, it is possible that a player in such an optional embodiment may lose his base wager, because the dealer wins on copy hands, but win on his tie wager, if any, for having a copy hand.

Referring again to FIGS. 5 and 6, after resolving all player hands with three card combinations, the dealer arranges 60 the dealer hand into two component hands, a two-card high hand and a single-card low hand. Similarly, the remaining players each arrange 60 their hands into a two-card high hand and a single-card low hand. The house may optionally institute a rule in which the high hand must outrank the low hand. The dealer high hand is compared 62 to the each player high hand and the dealer low hand is compared to each player low hand. Again, any ranking system could be used. However, for simplicity, the ranking system that uses only pairs and card ranks as described above may optionally be used. As with above, the house may optionally implement a rule that aces are the lowest ranked card or that aces are lower than deuces but higher than any other card (i.e. A♡A♢A♠beats 7♢7♠7♡but loses to 2♢2♠2♡). Also, optionally, the dealer may win on copy hands. That is, if the player's high and low component hands match 64 the dealer's counterpart component hands, the dealer wins.

Bonus wagers, if any, are resolved by examining the cards of both the player hand and the dealer hand. As above, the bonus holdings may optionally include those listed in Table 1. Again, according to an optional embodiment of the present invention, the bonus holdings include in combination at least one card from the player hand and at least one card from the dealer hand. Any player placing a bonus wager is rewarded 73 if the combination of the player hand and dealer hand form a bonus holding.

A player hand is declared the winner if the player high hand and the player low hand outrank 64 the dealer high hand and dealer low hand. A winning player hand is rewarded 64 based on the base wager, optionally at even money and optionally without collecting a commission. Conversely, if both the dealer's component hands outrank the player's component hands, or if one of the dealer's component hands outranks the player's component hand and the remaining dealer's component hand ties the player's component hand, the dealer's hand is the winning hand and the player's base wager is collected.

A tie is declared 61 if the cards of the player's hand equal the cards of the dealer's hand. For example, a player hand of 3♢4♠8♡ties a dealer hand of 3♡4♠8♠. A tie outcome may result in the player losing the player's base wager, as discussed above, or, alternatively, may optionally result in the return of the player's base wager 63. Separate and apart from the outcome of the base wager, any player placing a tie wager who ties the dealer's hand is rewarded on the tie wager 65. Optionally, the payout for winning a tie wager depends on whether the suits of the cards matched as given above in Table 2.

A push is declared 67 when one player's component hand outranks the corresponding dealer's component hand while the remaining dealer's component hand outranks or ties the remaining player's component hand. For example, 4♡4♤and J♢pushes with K♢J♤and Q♤since a pair of fours outranks King high but a Queen outranks a Jack. In the event of a push, the player's base wager may be collected 69. However, in an optional embodiment including an optional push wager, shown in FIG. 6, any player who placed a push wager and receives a push outcome is paid on his push wager 71. Optionally, the push wager is paid at greater than even money such as 2:1.

While certain embodiments of the present invention have been shown and described it is to be understood that the present invention is subject to many modifications and changes without departing from the spirit and scope of the claims presented herein.

What is claimed is:

1. A method for playing a casino card game for at least one player, the game method using at least one deck of fifty-two cards, comprising:

the player placing a base wager on either a first hand or a second hand;

the player placing at least one of a push wager or a tie wager;

a dealer dealing three cards to a first hand and three cards to a second hand;

examining the first hand and the second hand;

if either hand has a predetermined three-card combination, comparing the first hand to the second hand and declaring the winning hand to be the hand having the higher ranking three-card combination;

if neither hand has the predetermined three-card combination, arranging each hand into a two-card component hand and a single-card component hand;

comparing the first two-card hand to the second two-card hand and the first single-card hand to the second single-card hand;

declaring a tie if the three cards of the first hand are equal in rank to the three cards of the second hand, and rewarding the player if the player placed a tie wager;

declaring a push if one component hand of the first hand outranks the corresponding component hand of the second hand and the remaining component hand of the second hand outranks the corresponding component hand of the first hand, and rewarding the player if the player placed a push wager; and otherwise, declaring the winning hand to be the hand having a component hand outranking the corresponding component hand of the other hand and a remaining component hand outranking or tying the corresponding hand of the other hand, and rewarding the player if the player placed said base wager on the winning hand or collecting the player's base wager if the player placed said base wager on the losing hand.

2. The method of claim 1 wherein the predetermined three-card combination is a three of a kind.

3. The method of claim 1 further comprising:

defining a set of bonus holdings;

the player placing a bonus wager; and rewarding the player based on the player's bonus wager if the combination of at least one of the cards of the first hand and at least one of the cards of the second hand form a bonus holding.

4. A method for playing a casino card game for at least one player, the game method using at least one deck of fifty-two cards, comprising:

defining a set of bonus holdings;

the player placing a base wager on either a first hand or a second hand;

the player placing a bonus wager;

a dealer dealing three cards to a first hand and three cards to a second hand;

examining the first hand and the second hand;

rewarding the player based on his bonus wager if the combination of at least one of the cards of the first hand and at least one of the cards from the second hand form a bonus holding;

if either hand has a predetermined three-card combination, comparing the first hand to the second hand and declaring the winning hand to be the hand having the higher ranking three-card combination;

if neither hand has the predetermined three-card combination, arranging each hand into a two-card component hand and a single-card component hand;

comparing the first two-card hand to the second two-card hand and the first single-card hand to the second single-card hand;

declaring a tie if the three cards of the first hand are equal in rank to the three cards of the second hand;

declaring a push if one component hand of the first hand outranks the corresponding component hand of the second hand and the remaining component hand of the second hand outranks the corresponding component hand of the first hand; and declaring the winning hand to be the hand having a component hand outranking the corresponding component hand of the other hand and a remaining component hand outranking or tying the corresponding hand of the other hand, and rewarding the player if he placed said base wager on the winning hand or collecting the player's base wager if he placed said base wager on the losing hand.

5. The method of claim 4 wherein the predetermined three-card combination is a three of a kind.

6. The method of claim 4 further comprising:

the player placing a tie wager; and if a tie is declared, rewarding the player based on his tie wager.

7. The method of claim 4 further comprising:

the player placing a push wager; and if a push is declared, rewarding the player based on his push wager.

8. A method for playing a casino card game for at least one player, the game method using at least one deck of fifty-two cards, comprising:

a player placing a base wager;

a player placing one of a push wager or a tie wager;

a dealer dealing a three-card hand to the player and to the dealer;

examining said player hand;

for a player hand having a predetermined three-card combination, comparing the player hand to the dealer hand and declaring the player hand to be a winning hand unless the dealer hand has a higher ranking three-card combination;

for a player hand lacking the predetermined three-card combination, arranging said player hand and dealer hand into a two-card component hand and a single-card component hand;

comparing the player's two-card hand to the dealer's two-card hand and the player's single-card hand to the dealer's single-card hand;

declaring a tie for a player with a player hand having three cards equal in rank to the three cards of the dealer's hand, and rewarding the player if the player placed a tie wager;

declaring a push for a player with a player hand having one player component hand outranking the corresponding dealer component hand and the remaining player component hand outranked by the remaining dealer component hand, and rewarding the player if the player placed a push wager; and declaring a player's hand to be a winning hand if both of the player's component hands outrank the corresponding dealer's component hands and rewarding each player having a winning hand based on the player's base wager and collecting base wagers from players not having winning hands.

9. The method of claim 8 wherein the predetermined three-card combination is a three of a kind.

10. The method of claim 8 further comprising:

defining a set of bonus holdings;

a player placing a bonus wager;

rewarding the player based on the player's bonus wager if the combination of at least one of the cards of the player's hand and at least one of the cards of the dealer's hand form a bonus holding.

11. A method for playing a casino card game for at least one player, the game method using at least one deck of fifty-two cards, comprising:

defining a set of bonus holdings;

a player placing a base wager and a bonus wager;

a dealer dealing a three-card hand to the player and to the dealer;

examining said player hand;

rewarding the player based on the player's bonus wager if the combination of at least one of the cards of the player's hand and at least one of the cards of the dealer's hand form a bonus holding;

for a player hand having a predetermined three-card combination, declaring the player hand to be a winning hand;

for a player hand lacking the predetermined three-card combination, arranging said player hand and dealer hand into a two-card component hand and a single-card component hand;

comparing the player's two-card hand to the dealer's two-card hand and the player's single-card hand to the dealer's single-card hand;

declaring a tie for a player with a player hand having three cards equal in rank to the three cards of the dealer's hand;

declaring a push for a player with a player hand having one player component hand outranking the corresponding dealer component hand and the remaining player component hand outranked by the remaining dealer component hand; and declaring a player's hand to be a winning hand if both of the player's component hands outrank the corresponding dealer's component hands and rewarding each player having a winning hand based on the player's base wager and collecting base wagers from players not having winning hands.

12. The method of claim 11 wherein if both the player and dealer have a predetermined three-card combination, comparing the player hand to the dealer hand and declaring the player hand to be a winning hand, unless the dealer hand includes a higher ranking three-card combination.

13. The method of claim 11 wherein the predetermined three-card combination is a three of a kind.

14. The method of claim 11 further comprising:

the player placing a tie wager; and if a tie is declared, rewarding the player based on his tie wager.

15. The method of claim 11 further comprising:

the player placing a push wager; and if a push is declared, rewarding the player based on his push wager.

* * * * *